United States Patent [19]

Burnbaum

[11] 4,076,234

[45] Feb. 28, 1978

[54] ARTIFICIAL SNOW CIRCULATING APPARATUS

[75] Inventor: Jack Burnbaum, Newton, Mass.

[73] Assignee: Bradford Novelty Co., Inc., Boston, Mass.

[21] Appl. No.: 700,612

[22] Filed: Jun. 28, 1976

[51] Int. Cl.[2] ..... A63J 5/02

[52] U.S. Cl. ..... 272/15; 40/410; 47/23

[58] Field of Search ..... 272/15, 6, 27 B; 273/95 C; 40/37, 106.21, 106.22, 106.23, 106.25; 46/41, 44, 57; 239/2 R, 2 S, 398, DIG. 5; 248/511, 518, 519; 47/26, 23

[56] References Cited

U.S. PATENT DOCUMENTS

| | | | |
|---|---|---|---|
| 104,418 | 6/1870 | Brunson | 47/23 |
| 219,987 | 9/1879 | Scott et al. | 47/23 |
| 1,858,513 | 5/1932 | LeGrand | 47/26 |
| 2,999,479 | 9/1961 | Carder | 47/23 X |
| 3,109,596 | 11/1963 | Chernansky | 248/519 X |
| 3,415,512 | 12/1968 | Burnbaum | 272/15 |
| 3,415,513 | 12/1968 | Burnbaum | 272/15 |

*Primary Examiner*—Richard C. Pinkham
*Assistant Examiner*—Arnold W. Kramer
*Attorney, Agent, or Firm*—Kenway & Jenney

[57] ABSTRACT

Apparatus for use with a Christmas tree cascades artificial snow particles through the tree branches. The apparatus includes a conical particle collecting receptacle having an interior surface inclined with respect to the axis of the cone at an angle sufficient to direct snow particles, by the force of gravity alone, into a sump portion. An aperture at the center of the cone receives the trunk of the tree, and tabs extend from the periphery of the aperture for sealing the receptacle to the trunk.

The apparatus further includes a blower mountable on the tree trunk above the cone having a particle inlet conduit for communication with the sump portion of the receptacle and a particle outlet conduit. The outlet conduit leads to a deflector positioned atop the tree. The deflector has a conically flaring hollow for deflecting particles discharged from the outlet conduit through the tree branches to the receptacle.

12 Claims, 3 Drawing Figures

ARTIFICIAL SNOW CIRCULATING APPARATUS

BACKGROUND OF THE INVENTION

This invention relates to apparatus for cascading artificial snow through the branches of a decorative tree such as a Christmas tree, and more particularly to improved apparatus of the type disclosed in U.S. Pat. Nos. 3,415,513 and 3,415,512, entitled *Apparatus to Cause Artificial Snowfall* and *Apparatus Causing Artificial Snowfall,* respectively.

These patents disclose apparatus which continuously cascades artificial snow, e.g., foamed plastic pellets, through the branches of a Christmas tree. The apparatus has a particle-collecting receptacle supported on its own base and within which a tree, either artificial or real, is mounted. The receptacle has a diameter sufficient to span the distance between opposed lowermost branches of the tree, and has an interior surface which is inclined to direct snow particles into a bottom portion of the receptacle, which forms a sump. A blower mounted on the receptacle has an inlet conduit for taking up snow particles collected in the sump portion of the receptacle, and feeds an outlet conduit which channels a stream of particles to a point adjacent the top of the tree. A deflector at the top of the tree directs snow particles emanating from the outlet conduit downwardly through the branches of the tree and back toward the receptacle, where they are recirculated.

While the foregoing apparatus operates successfully, it has several drawbacks. First, the tree stand and therefore the tree itself must be mounted within the receptacle. Accordingly, the receptacle must be made of a material sufficiently strong to support the tree. Further, a tree stand specifically designed to be mountable within the receptacle must be employed. In addition, the collecting receptacle does not direct the collected particles into its sump portion without mechanical assistance. In this regard, U.S. Pat. No. 3,415,513 teaches that the blower be constructed to vibrate the collecting receptacle to facilitate return of the particles along the sloping interior surface to the sump. Moreover, both patents teach that the artificial snow particles preferably have curved surfaces which facilitate their downward movement on the walls of the receptacle toward the sump portion.

Another drawback of the apparatus described in the above-referenced patents arose from the belief that it was necessary that the collecting receptacle have a diameter large enough to span the largest radial dimensions of the tree. This led to the provision of an overly large, cumbersome receptacle which detracted from the decorative appearance of the tree. Lastly, in the prior equipment, unless somehow assisted downwardly toward the sump portion, particles tended to collect on the sloping interior surface of the receptacle and particles collected within the branches of the tree, sometimes to an undesirable degree.

SUMMARY OF THE INVENTION

In accordance with the present invention, improved apparatus of the type described overcomes deficiencies of the prior apparatus by providing a receptacle arranged for mounting on a floor-mounted tree and which is configured to feed snow particles to the sump portion without mechanical assistance, i.e., by gravity alone. The invention attains the latter feature with a receptacle constructed as a cone having an interior surface which is sufficiently smooth and inclined to feed snow particles downwardly without applied mechanical assistance. In embodiments using a preferred smooth cone surface, the incline is 60° or steeper as measured with respect to a vertical central axis of the cone; the preferred range is between 50° and 60°.

The center of the receptacle cone has an aperture for receiving and mountingly sealing onto the trunk of the tree, which is either floor mounted or otherwise supported independent of the receptacle. A further feature of the invention is that the receptacle cone preferably is sufficiently small so that, when installed, it does not project radially beyond the lower branches of the largest tree which it can be used.

The invention also provides improved deflecting means which operates in conjunction with the new, smaller diameter receptacle. The new deflecting arrangement deflects artificial particle discharged at the top of a tree to descend through the tree within a relatively narrow collecting aperture formed by the conical receptacle at the bottom of the tree. For this purpose the deflecting means provided by the invention has an interior conical hollow symmetrical about a central axis with a restricted flare, i.e., the interior conically-flared deflecting surface of the hollow is oriented with respect to the axis at an angle of 20° or so for use with one preferred conical receptacle. With this typical arrangement of the invention, an imaginary projection of the deflecting surface does not fall outside the conical receptacle at the bottom of the tree, but rather falls within the periphery of the receptacle.

The invention also provides means for mounting the snow recirculated blower on the trunk of the tree. This mounting enables the blower to set up sufficient vibration in the tree branches to retard unduly large collections of clinging snow particles.

Since the apparatus of the invention does not require that the blower or the tree stand be mounted on the receptacle, the receptacle can be fashioned simply and inexpensively from relatively thin foldable material such as paperboard. This receptacle is much easier to install than the receptacles of the prior art.

Accordingly, objects of the invention include the provision of improved apparatus for circulating artificial snow particles which is of simple construction, is adaptable for use with different tree trunks, features a particle collecting receptacle fastenable to the base of a tree floor-mounted on a conventional stand, requires fewer snow particles than the apparatus of the prior art, ensures efficient circulation of snow particles, and is relatively unobtrusive when installed thus not detracting from the decorative appearance of the tree.

Other objects of the invention are to provide an improved particle or flake collecting receptacle designed to channel snow particles into a bottom sump portion thereof without mechanical assistance and to provide improved deflection means designed to inhibit radial deflection of snow particles such as might propel significant quantities beyond the periphery of the receptacle.

These and other objects and features of the invention will be apparent to those skilled in the art from the following description of a preferred embodiment and from the drawing wherein.

DESCRIPTION OF THE PREFERRED EMBODIMENT

Figure 1:
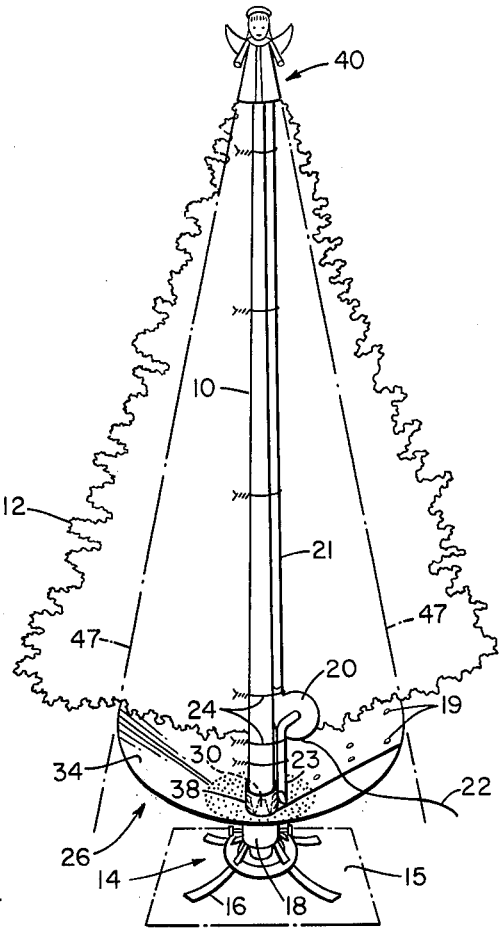
FIG. 1 is a perspective view of an artificial Christmas tree in combination with a particle recirculator embodying the invention.

FIG. 1 shows an artificial snow recirculator according to the invention installed on a Christmas tree, either artificial or real, that has a trunk 10 from which tree branches, the tips of which are schematically illustrated at 12, extend laterally. The tree is held in position on a surface 15 by a well-known tree stand 14 having legs 16 attached to a collar 18 which receives the trunk 10. Circulating means, e.g., a blower, preferably of the type disclosed in U.S. Pat. No. 3,434,653 to J. Burnbaum entitled *Combination Motor and Blower,* the disclosure of which is incorporated herein by reference, is shown at 20. The blower is powered by an electrical motor (not shown) incorporated within the blower housing and serviced by an electric lead 22. The blower is mounted on the tree trunk 10 by mounting means 24 illustrated as a length of wire or pressure sensitive tape which straps the blower to a lower bottom length of the trunk. A particle inlet conduit 23 for taking up artificial snow particles extends downwardly parallel to tree trunk 10 from the blower 20. The blower feeds an outlet conduit 21 for channeling particles upwardly toward a deflector 40 adjacent the top of the tree.

Figure 2:
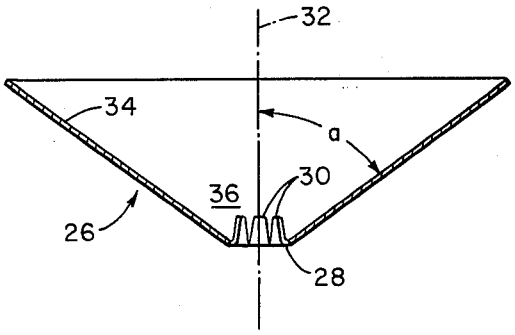
FIG. 2 is a cross-sectional view of the particle collecting receptacle of the recirculator shown in FIG. 1.

A particle collecting receptacle 26 of the recirculator has, as FIGS. 1 and 2 show, a conical structure with a lower sump portion 36, a central aperture 28, and a plurality of integral tabs 30 extending upwardly from the edge of the aperture. The receptacle is installed about the base of the trunk 10 above the stand 14 and below the blower 20. For ease of installation, the receptacle preferably is provided in the form of a circular disc having a radial cut between its perimeter and its aperture 28. After being placed about the tree trunk, the radial edges of the receptacle are overlapped to form the cone as shown and held together by suitable fasteners 19.

As shown in FIG. 2, the receptacle is symmetrical about a central axis 32 and has an interior surface 34 which is inclined downwardly with respect to the central axis at an angle sufficient to guide particles into the sump 36 without mechanical assistance, i.e., powered only be gravitational force. The maximum value of the angle (*a*) depends on the frictional character of the surface 34 and on the slidability of the particles. However, features of the invention are that the surface be hard and smooth and that the cone form an angle (*a*) not greater than 60°, and preferably between 50° and 60°. In one specific embodiment, for use with expanded polystyrene particles, the receptacle is of 24-point solid bleached sulfate board and has an angle (*a*) of 55°.

The tabs 30 extend upwardly from the edges of aperture 28 into the sump portion 36 of receptacle 26. The tabs are preferably fabricated from the same material as the main body of the receptacle 26, and are sufficiently flexible so that they can be bent to accomodate different diameter tree trunks. As shown in FIG. 1, a few turns of pressure sensitive tape 38 applied over the tabs 30 maintain the receptacle 26 in its position at the base of tree trunk 10 and form a seal so that artificial snow particles are kept from leaking out of the sump portion 36. Since the receptacle 26 does not support either the tree or blower 20, it can be fabricated from light weight, inexpensive material such as paperboard.

The deflector 40, illustrated in FIG. 1 as ornamented, has a conically flared hollow 42 which has an interior surface 43 that is symmetrical about a central axis 44. The interior surface 43 is oriented at an angle relative to the axis 44 such that, when installed, construction lines extending from surface 43, e.g., construction lines 47, project to the periphery of receptacle 26 as illustrated, or — as considered preferable — intersect the surface 34 2 or 3 inches inward from the periphery. In this regard, it should be pointed out that the diameter of receptacle 26 and the incline of the interior surface 34 of the deflector 40 are designed with a particular range of tree size in mind and to cooperate to minimize particle loss. For a common full size Christmas tree, e.g., generally between 4 and 7½ feet tall, the diameter of the above-noted 55° receptacle is preferably about 32 inches, and the angle (*b*) of the deflector 40 is about 14°. For smaller or larger trees, angle (*b*) and the receptacle diameter may be changed to effect the purpose set forth above. For smaller trees using the same receptacle, angle (*b*) should be equal to or less than about 21°. Thus, the deflector preferably is flared with an angle (*b*) of substantially between 12° and 16°.

Figure 3:
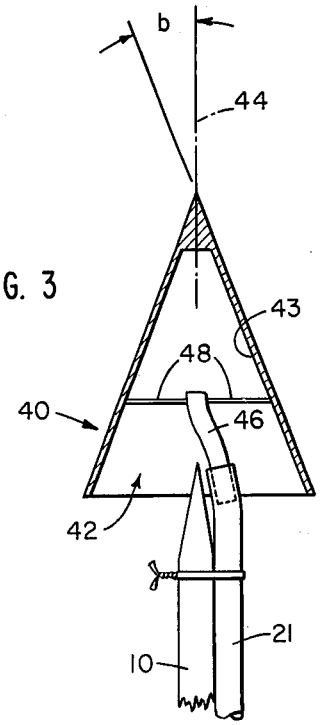
FIG. 3 is a cross-sectional view of the deflecting means shown in FIG. 1.

The deflector 40 is mounted adjacent the top of the tree, preferably by mounting it to outlet conduit 21. As can be seen from FIG. 3, the illustrated deflector 40 has a bent section of pipe 46 attached to the interior surface 43 by struts 48. The pipe section 46 has a diameter which fits within the outlet conduit 21, and this connection supports the deflector. If such a bent section is employed, the uppermost portion of conduit 21 preferably is angled as shown to orient the axis of deflector 40 substantially vertical.

In operation, artificial snow particles, which preferably are irregularly shaped particles of foamed plastic and need not necessarily have curved outer surfaces, are placed in the sump 36 of receptacle 26, and the blower 20 is turned on. The blower takes up a stream of particles through inlet conduit 23, and transports it through outlet conduit 21 for discharge into the interior of the deflector 40. The limited flare of the interior surface 43 deflects the particles downward, and limits the extent of the radial projection so that they cascade down through the branches of the tree and collect in receptacle 26. Operation of the blower preferably sets up slight vibrations which propagate through the tree to prevent oversized collections of snow particles on its branches. On entering receptacle 26, because of the angle of interior surface 34, even very light snow particles are guided downwardly into the sump 36, propelled by gravity alone. Since fewer snow particles accumulate on the inclined walls 34 of the receptacle 36, it has been found that only one-third of the total volume of particles used in the prior art devices is required.

It will thus be seen that the objects set forth above, among those made apparent from the preceding description, are efficiently attained. Since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

Having described the invention, what is claimed is new and secured by Letters Patent is:

1. In apparatus for use with a tree for continuously cascading artificial snow particles through the branches thereof, said apparatus including a particle collecting receptacle having an interior surface which, when said receptacle is installed at the base of the tree, is inclined to guide particles into a bottom sump portion of said receptacle, a blower having an inlet conduit for taking up particles contained in said sump portion and an outlet conduit for delivering said particles to a point adjacent the top of the tree, and deflecting means which, when installed atop the tree, directs particles received from said outlet conduit downwardly through the branches of the tree and into said receptacle, the improvement wherein said receptacle comprises a conical member, said conical member forms said interior surface with sufficient smoothness and sufficient downward incline from the periphery thereof to the cone axis so that gravitational force alone moves the particles along said interior surface to said sump portion, the center of said conical member has an aperture for receiving the trunk of the tree, whereby said receptacle can be installed about the lower portion of the trunk of a tree mounted on a stand located below said receptacle, and said conical member includes means for sealingly engaging said interior surface with the tree trunk passing through said aperture for containing particles within the sump portion, said sealing means comprising an upwardly directed extension of said interior surface of being adjustable for installing said conical member in sealing engagement with variously sized tree trunks.

2. Apparatus according to claim 1 having the further improvement wherein said conical receptacle member is inclined relative to said cone axis by an angle not greater than 60°.

3. Apparatus according to claim 1 having the further improvement wherein said conical receptacle member is inclined relative to said cone axis by an angle between 50° and 60°.

4. Apparatus according to claim 1 having the further improvement wherein said deflecting means has an interior conically-flaring hollow, the interior deflecting surface of which is flared at such an angle with respect to the central axis of said hollow that imaginary construction lines extending from said deflecting surface intercept said conical receptacle member within the outer periphery thereof.

5. Apparatus according to claim 1 having the further improvement comprising means for mounting said blower on the trunk of a tree.

6. Apparatus according to claim 1 having the further improvement wherein said deflecting means has an interior conically flaring hollow, the interior surface thereof being flared at an angle less than about 21° with respect to the central axis of said hollow for directing particles toward said receptacle and for minimizing particle loss from said apparatus.

7. Apparatus according to claim 6 having the further improvement wherein said incline of said interior surface of said receptacle is about 50° and said angle of said interior surface of said deflecting cone is about 14°.

8. Apparatus according to claim 1 having the further improvement wherein said receptacle is formed from a sheet of self-supporting foldable material having a hard, smooth surface, and said sealing means comprises integral tabs extending upwardly from the edge of said aperture.

9. Apparatus according to claim 1 having the further improvement wherein said deflecting means has an interior conically flaring surface inclined such that when installed atop the tree, straight imaginary construction lines vertically coincident with said interior surface project outwardly no farther than the periphery of said receptacle.

10. In apparatus for use with a tree for continuously cascading artificial snow particles through the branches thereof, said apparatus including a particle collecting receptacle for installation at the base of the tree, said receptacle having an interior surface which, when said receptacle is installed, is inclined to guide particles into a bottom sump portion thereof, particle circulating means having an inlet conduit for taking up particles contained in said bottom portion and an outlet conduit for delivering said particles to a point adjacent the top of the tree, and deflecting means which, when installation atop the tree, directs particles received from said outlet conduit downwardly through the branches of the tree, and into said receptacle, the improvement wherein said receptacle comprises a conical member, said conical member forming said interior surface, said surface being inclined downwardly from the periphery thereof to the cone axis at an angle sufficient to gravity feed particles along the interior surface to the sump portion of said cone without mechanical assistance, the center of said conical member has an aperture for receiving the trunk of a tree, whereby said receptacle can be installed about the lower portion of the trunk of a tree mounted on a stand located below said receptacle, said conical member includes adjustable, upwardly extending means for sealingly engaging said interior surface with the tree trunk passing through said aperture for containing particles within the sump portion, whereby said receptacle may be sealed about tree trunks of various sizes, said apparatus further includes means for mounting said blower to the tree trunk; and said deflecting means has an interior conical hollow, the interior surface of said hollow being inclined such that particles deflected by said interior surface are directed to said receptacle and particle loss from said apparatus is minimized.

11. Apparatus according to claim 10 wherein said interior surface of said deflecting means is inclined with respect to its central axis at an angle of about 14° and said interior surface of said receptacle is inclined with respect to its central axis at an angle less than about 55°, the diameter of said receptacle being about 32 inches.

12. Apparatus according to claim 10 wherein said sealing means comprises a plurality of integral, upwardly extending tabs made of deformable material.

* * * * *

UNITED STATES PATENT AND TRADEMARK OFFICE

CERTIFICATE OF CORRECTION

PATENT NO. : 4,076,234
DATED : February 28, 1978
INVENTOR(S) : Jack Burnbaum

It is certified that error appears in the above-identified patent and that said Letters Patent are hereby corrected as shown below:

Column 2, line 47, after "different" insert --diameter--.

Column 3, line 25, before "bottom" insert --or--.

Column 5, line 37, delete "of" after "surface" and insert --and--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*